US010955131B2

(12) United States Patent
Ristic et al.

(10) Patent No.: US 10,955,131 B2
(45) Date of Patent: Mar. 23, 2021

(54) SYSTEM AND METHOD FOR PROVIDING COMBUSTION IN A BOILER

(71) Applicant: General Electric Technology GmbH, Baden (CH)

(72) Inventors: Dragisa Ristic, Wendlingen (DE); Frank Michael Kluger, Schwaebisch Gmeund/Herlikofen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 1200 days.

(21) Appl. No.: 15/228,001

(22) Filed: Aug. 4, 2016

(65) Prior Publication Data

US 2017/0045218 A1 Feb. 16, 2017

(30) Foreign Application Priority Data

Aug. 13, 2015 (EP) ..... 15180895

(51) Int. Cl.
*F23C 1/10* (2006.01)
*F23K 3/02* (2006.01)
(Continued)

(52) U.S. Cl.
CPC ..... *F23C 1/10* (2013.01); *F23C 6/045* (2013.01); *F23D 1/005* (2013.01); *F23D 1/02* (2013.01);
(Continued)

(58) Field of Classification Search
CPC ..... F23D 1/00; F23D 2201/20; F23D 17/005; F23D 2900/00003; F23D 1/02;
(Continued)

(56) References Cited

U.S. PATENT DOCUMENTS 2,216,508 A * 10/1940 Zink ..... F23D 17/00 239/402.5
3,729,285 A * 4/1973 Schwedersky ..... F23D 14/22 431/8
(Continued)

FOREIGN PATENT DOCUMENTS

CN 1975250 A 6/2007
CN 201081231 Y 7/2008
(Continued)

OTHER PUBLICATIONS

European Search Report and Opinion issued in connection with corresponding EP Application No. 15180895.3 dated Jan. 25, 2016.
(Continued)

*Primary Examiner* — Avinash A Savani
*Assistant Examiner* — Martha M Becton
(74) *Attorney, Agent, or Firm* — Grogan, Tuccillo & Vanderleeden, LLP

(57) ABSTRACT

A combustion system with a combustion area in a boiler including a fuel pipe for delivering fuel is disclosed. A duct having a bend extended there through is in fluid communication with the fuel pipe and the combustion area of the boiler. The duct has an outer perimeter and an inner perimeter. The duct includes a first partition plate to form a first parallel flow of the fuel between the outer perimeter and the first partition plate, upstream of the bend.

18 Claims, 4 Drawing Sheets

(51) Int. Cl.

| | |
|---|---|
| ***F23D 1/02*** | (2006.01) |
| ***F23C 6/04*** | (2006.01) |
| ***F23D 1/00*** | (2006.01) |
| ***F23K 5/14*** | (2006.01) |
| ***F23Q 13/00*** | (2006.01) |

(52) U.S. Cl.
CPC ..... *F23K 3/02* (2013.01); *F23K 5/14* (2013.01); *F23Q 13/00* (2013.01); *F23D 2201/10* (2013.01); *F23D 2201/20* (2013.01); *F23D 2204/30* (2013.01); *F23K 2203/006* (2013.01)

(58) Field of Classification Search
CPC ..... F23D 2201/10; F23D 2204/30; F23D 2207/00; F23C 1/10; F23C 1/12; F23C 5/08; F23C 6/045; F23C 2201/30; F23K 3/02; F23K 5/14; F23K 2203/006; F23Q 13/00
USPC ..... 431/6, 278, 284; 110/263
See application file for complete search history.

(56) References Cited

U.S. PATENT DOCUMENTS

| | | | | | |
|---|---|---|---|---|---|
| 4,438,707 | A * | 3/1984 | Delaplace | F23C 1/12 | 110/263 |
| 4,690,075 | A * | 9/1987 | Vidal | F23C 5/08 | 110/264 |
| 4,902,221 | A * | 2/1990 | Collins, Jr. | F23D 1/02 | 110/263 |
| 5,156,100 | A | 10/1992 | Pentti | | |
| 5,769,008 | A | 6/1998 | Finker et al. | | |
| 6,116,171 | A | 9/2000 | Oota et al. | | |
| 9,151,434 | B2 * | 10/2015 | Adam | F16L 57/06 | |
| 9,593,795 | B2 * | 3/2017 | Bliss | F16L 57/06 | |
| 9,857,077 | B2 * | 1/2018 | Adam | F23K 3/02 | |
| 2008/0184919 | A1 * | 8/2008 | D'Agostini | F23L 7/007 | 110/263 |
| 2009/0038518 | A1 * | 2/2009 | Liu | F23D 1/00 | 110/263 |
| 2010/0275824 | A1 * | 11/2010 | LaRue | F23C 7/004 | 110/346 |
| 2011/0053102 | A1 * | 3/2011 | Okazaki | F23C 7/008 | 431/12 |
| 2011/0185952 | A1 * | 8/2011 | Takashima | F23C 7/008 | 110/188 |
| 2013/0333676 | A1 | 12/2013 | Zheng et al. | | |
| 2015/0053124 | A1 * | 2/2015 | Taniguchi | F23C 6/045 | 110/346 |
| 2015/0068438 | A1 * | 3/2015 | Taniguchi | F23C 6/045 | 110/346 |
| 2015/0226431 | A1 * | 8/2015 | Ristic | F23Q 3/00 | 431/6 |

FOREIGN PATENT DOCUMENTS

| | | | |
|---|---|---|---|
| CN | 101832551 | A | 9/2010 |
| CN | 104285100 | A | 1/2015 |
| EP | 0 747 629 | A1 | 12/1996 |
| EP | 2 019 263 | A1 | 1/2009 |
| EP | 2019263 | A1 | 1/2009 |
| EP | 2172706 | A1 | 4/2010 |
| EP | 2253884 | A1 | 11/2010 |
| JP | 2002-340306 | A | 11/2002 |
| JP | 2002340306 | A | 11/2002 |
| WO | 2007/131392 | A1 | 11/2007 |
| WO | 2012088110 | A1 | 6/2012 |

OTHER PUBLICATIONS

Machine Translation and First Office Action and Search issued in connection with corresponding CN Application No. 201610659838.0 dated Jan. 3, 2019.

* cited by examiner 10
90
250
45
42
80
160
A
40
210
B
170
50
35
180
220
A
30
200
190

B
60
70
100
110
130
80
240
225
120
140
255
150
A-A
90
B-B
C-C
100
55
25

C
C
20

SYSTEM AND METHOD FOR PROVIDING COMBUSTION IN A BOILER

TECHNICAL FIELD

The present disclosure relates to a system and a method for providing combustion in a boiler, and more specifically, to a fuel nozzle that is part of a burner, which in turn is part of the combustion system.

BACKGROUND

Beside rectangular jet burners, for example, tilt burners, round burners are the most frequently used burners in a combustion system of a large power plant for burning pulverized fossil fuels and/or biomass that is pulverized fuels. The pulverized fuel is typically conveyed through one or more conduits to a combustion area of a boiler. Pulverized fuel fired power plants are provided with several burners arranged in boiler corners or burners are arranged on the boiler walls. The pulverized fuel is ignited and burned in the combustion area. Gases generated during combustion are conveyed through one or more flues in fluid communication with the combustion area of the boiler.

Some combustion systems use a burner having internal combustion barrels ignited by plasma. Combustion systems may use a combustion technique of decreasing nitrogen oxides of a pulverized coal boiler using burners of internal combustion type. Additionally, a method of operating the boiler using burners of internal combustion type provided with plasma generator and pulverized coal concentrators i.e. combustion barrels which do deep fuel staging in the burners, is known in the art.

Start-up of a boiler fired with pulverized solid fuel is started by heating the boiler to a sufficient heat by a gaseous or liquid secondary fuel, for example oil, gas and similar fuels, after which the feed of pulverized fuel which is a main fuel into the boiler can be initiated. The secondary fuel combustion system for starting the boiler is dimensioned in such a way that the capacity of the secondary fuel combustion system is approximately 30 to 35% of the firing capacity of the boiler.

Furthermore, when the boiler operates in deep part load conditions, additional secondary fuel which acts as support fuel, for example gas, oil and similar fuels, is injected via burners in order to ensure stable and safe burner operations. This leads to more consumption of the secondary fuel which acts as support fuel in overall operation of the power plant.

Currently available solutions are not able to solve the problem of use of secondary fuel at the start of the boiler and additional secondary fuel later during the operations of the boiler.

It may be desirable that any solution to the existing combustion system be capable of implementation within the existing combustion system due to the expense of otherwise replacing such equipment.

Accordingly, it may be desirable for a solution to be able to be used in a "retrofitted" manner, to fit within existing combustion system for providing the combustion.

BRIEF DESCRIPTION

The present disclosure relates to a combustion system and a method for providing combustion in a boiler, and more specifically, to a fuel nozzle that is part of a burner. The subject fuel nozzle can be used as "retrofit" within existing burners of existing combustion systems.

Accordingly, the present disclosure provides a system for combustion in a boiler having a combustion area. The system includes a fuel pipe operable to deliver fuel, and a duct with an outer perimeter having a bend extended there through. The duct is in fluid communication with the fuel pipe and the combustion area of the boiler. The duct includes a first partition plate disposed in the duct to form a first parallel flow of the fuel between the outer perimeter and the first partition plate, upstream of the bend, and a first concentric conduit, positioned in the duct downstream of the bend, to deliver a first concentric flow of the fuel for combustion, wherein the bend between the first partition plate and the first concentric conduit is configured to transition the first parallel flow of the fuel into the first concentric flow of the fuel.

In another embodiment, the duct further includes a second partition plate, disposed in the duct, to form a second parallel flow of the fuel between the first partition plate and the second partition plate upstream of the bend, and a second concentric conduit, positioned in the duct downstream of the bend, to deliver a second concentric flow of the fuel for combustion, wherein the bend between the second partition plate and the second concentric conduit is configured to transition the second parallel flow of the fuel into the second concentric flow of the fuel.

In yet another embodiment, the second partition plate forms a third parallel flow of the fuel between the outer perimeter and the second partition plate, upstream of the bend, and the duct is positioned downstream of the bend to deliver a third concentric flow of the fuel for combustion, wherein the bend is configured in the duct to transition the third parallel flow of the fuel into the third concentric flow of the fuel.

In yet another embodiment, the bend includes a first portion configured to connect the first partition plate with the first concentric conduit to transition the first parallel flow of the fuel into the first concentric flow of fuel, and a second portion attached to the first portion and configured to connect the second partition plate with the second concentric conduit to transition the second parallel flow into the second concentric flow of fuel, wherein the second concentric conduit surrounds the first concentric conduit. A third portion is attached to the second portion and configured to transition the third parallel flow of the fuel into the third concentric flow of the fuel through the duct, wherein the duct surrounds the second concentric conduit and wherein the first portion, second portion and the third portion are configured to form a stepping configuration.

In yet another embodiment, a bypass is provided in the duct upstream of the bend to transport a part of second parallel flow of the fuel and third parallel flow of the fuel in the duct to the first concentric conduit through the first portion.

In yet another embodiment, at least one swirl vane and/or at least one flat vane is provided upstream of the partition plates to control the amount of the fuel transported through the bypass and/or first, second, and third parallel flow.

In yet another embodiment, a pre ignition source is positioned in the duct in the first concentric flow of fuel downstream of the bend.

In yet another embodiment, the duct is an ignition-injection nozzle.

In yet another embodiment, ignition of the fuel occurs in rear sections of first, second and third concentric flow of fuel downstream of the bend.

In yet another embodiment, a system for providing combustion in a boiler having a combustion area including a fuel burner is fitted with the ignition-injection nozzle.

In yet another embodiment, a method for providing combustion in a boiler having a combustion area includes providing a fuel pipe operable to deliver fuel, providing a duct with an outer perimeter having a bend extended there through, wherein the duct is in fluid communication with the fuel pipe and the combustion area of the boiler, disposing a first partition plate in the duct to enable forming a first parallel flow of the fuel between the outer perimeter and the first partition plate, upstream of the bend, positioning a first concentric conduit in the duct downstream of the bend to enable delivery of a first concentric flow of the fuel for combustion, and configuring the bend between the first partition plate and the first concentric conduit to enable transition of the first parallel flow of the fuel into the first concentric flow of the fuel.

In yet another embodiment, the method further includes the steps of disposing a second partition plate in the duct to enable forming a second parallel flow of the fuel between the first partition plate and the second partition plate upstream of the bend, positioning a second concentric conduit in the duct downstream of the bend to enable delivery of a second concentric flow of the fuel for combustion, and configuring the bend between the second partition plate and the second concentric conduit to enable transition of the second parallel flow of the fuel into the second concentric flow of the fuel.

In yet another embodiment, the method further includes the second partition plate forming a third parallel flow of the fuel between the outer perimeter and the second partition plate, upstream of the bend, positioning the duct downstream of the bend to enable delivery of a third concentric flow of the fuel for combustion, and configuring the bend in the duct to enable transition of the third parallel flow of the fuel into the third concentric flow of the fuel.

In yet another embodiment, configuring the bend includes connecting the first partition plate with the first concentric conduit by a first portion to enable transition of the first parallel flow of the fuel into the first concentric flow of fuel, attaching a second portion to the first portion to connect the second partition plate with the second concentric conduit to enable transition of the second parallel flow into the second concentric flow of fuel, wherein the second concentric conduit surrounds the first concentric conduit, and attaching a third portion to the second portion to enable transition of the third parallel flow of the fuel into the third concentric flow of the fuel through the duct, wherein the duct surrounds the second concentric conduit and wherein the first portion, second portion and the third portion are configured to form a stepping configuration.

In yet another embodiment, the method further includes providing a bypass in the duct upstream of the bend to transport a part of second parallel flow of the fuel and third parallel flow of the fuel in the duct to the first concentric conduit through first portion.

In yet another embodiment, the method further includes providing at least one swirl vane and/or at least one flat vanes upstream of the partition plates to control amount of the fuel transported through the bypass.

In yet another embodiment, the method further includes positioning a pre ignition source in the duct in the first concentric flow of fuel downstream of the bend.

In yet another embodiment, the duct is an ignition-injection nozzle.

In yet another embodiment, the method further includes igniting the fuel in rear sections of first, second and third concentric flow of fuel downstream of the bend.

In yet another embodiment, the method further includes providing combustion in a boiler having a combustion area using nozzle in a fuel burner.

The present disclosure offers a technical solution for both start-up of a boiler and combustion support in part load operation without using additional secondary fuel, for example, oil, gas, and similar fuels. The technical solution is provided by modifying the fuel nozzle, for example, a pulverized fuel nozzle, in such way to promote pulverized fuel ignition by mean of an igniter, for example, electric ignition, to provide oil/gas-free combustion system for power plants, for example, a pulverized fuel fired power plant.

To achieve the ignition of the pulverized fuel by the igniter, for example, electric ignition, the pulverized fuel nozzle needs to be adapted to promote the ignition in an efficient and safety manner. The pulverized fuel flow within the pulverized fuel nozzle is split into three concentric flows. The pulverized fuel concentration within the concentric flows is controlled by adjustable or fixed swirl and/or flat vanes, and fuel flow redistributors. The igniter, for example, an electric igniter, is positioned inside the pulverized fuel nozzle into the central flow of the pulverized fuel nozzle. Therefore, ignition of the pulverized fuel takes place inside the pulverized fuel nozzle. The pulverized fuel is ignited stage by stage under fuel reach conditions. Combustion and burnout of the pulverized fuel takes place outside the pulverized fuel nozzle in a boiler furnace.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawings, wherein like elements are identified with like symbols, and in which:

DETAILED DESCRIPTION

Figures 1A, 1B, 1C, 1D:
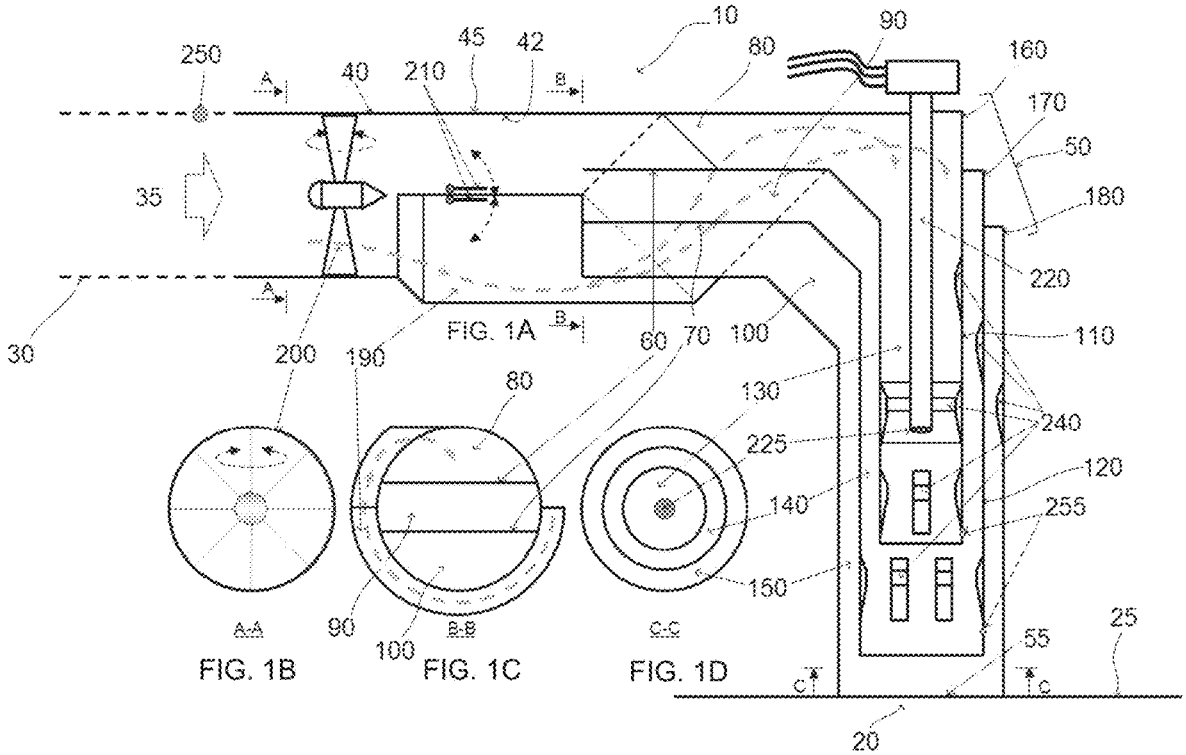
FIG. 1A is a side view of a duct, in accordance with an exemplary embodiment of the present disclosure.
FIG. 1B is a cross-sectional view of a duct along A-A in accordance with an exemplary embodiment of the present disclosure.
FIG. 1C is a cross-sectional view of a duct along B-B in accordance with an exemplary embodiment of the present disclosure.
FIG. 1D is a cross-sectional view of a duct along C-C in accordance with an exemplary embodiment of the present disclosure.

Referring now to FIG. 1A, a combustion system 10 with a combustion area 20 in a boiler 25 includes a fuel pipe 30 for delivering fuel 35. A duct 40 having a bend 50 extended there through is in fluid communication with the fuel pipe 30 and the combustion area 20 of the boiler 25. The duct 40 is having an outer perimeter 45 and an inner perimeter 42. The duct 40 includes a first partition plate 60 to form a first parallel flow 80 of the fuel between the outer perimeter 45 and the first partition plate 60, upstream of the bend 50. The bend 50 provides a simple transition of the first parallel flow 80 of the fuel into a first concentric flow 130 of the fuel. A first concentric conduit 110 is positioned in the duct 40 downstream of the bend 50 to deliver the first concentric flow 130 of the fuel for combustion.

Still referring to FIG. 1A, the duct 40 further includes a second partition plate 70 placed next to the first partition plate 60 to form a second parallel flow 90 of the fuel between the first partition plate 60 and the second partition plate 70 upstream of the bend 50. The bend 50 provides a simple transition of the second parallel flow 90 of the fuel into a second concentric flow 140 of the fuel. A second concentric conduit 120 is positioned in the duct 40 downstream of the bend 50 to deliver a second concentric flow 140 of the fuel for combustion. A third parallel flow 100 of the fuel is formed between the outer perimeter 45 and the second partition plate 70 upstream of the bend 50. The bend 50 also provides a simple transition of third parallel flow 100 of the fuel into a third concentric flow 150 of the fuel. The duct 40 is positioned downstream of the bend 50 to deliver the third concentric flow 150 of the fuel for combustion. The fuel 35 comprises pulverized coal in form of dust, mixed and supplied along with primary air. It should be understood, however, that the disclosure is not limited in this regard and that different types of fuel, such as, but not limited to, other carbonaceous fuel may also be used. Velocity of the primary air which is a combination of pulverized fuel carrier air and dust of pulverized coal across the duct 40 is controlled. A ratio between load of the dust of the pulverized coal and the primary air is also controlled.

The duct 40 is a fuel nozzle for the pulverized fuel, which also act as an ignition-injection nozzle. In an embodiment, a pre ignition source 220 is positioned in the duct 40 in the first concentric flow 130 of fuel downstream of the bend 50. The pre ignition source 220 is an electric igniter with an ignition flame 225. It should be understood, however, that the disclosure is not limited in this regard and that different types of igniter, such as, but not limited to, a microwave system generating a plasma cloud/flame 225, electrodes with high voltages discharge generating plasma cloud/flame 225, electrodes connected to an electric circuit generating one or more electric arcs 225, electrodes connected to an electric circuit for generating electric sparks 225, and other systems creating ionizing and/or electrical fields or discharges may also be used.

In order to provide stage by stage ignition in an efficient and safe manner, the amount of the pulverised fuel 35 in the first concentric flow 130 is controlled and adjusted to the ignition flame 225 energy output volume. A first stage ignition takes place within the rear section of the first concentric flow 130. To control fuel flow concentration in the first 130, second 140 and third 150 concentric flow of fuel, the duct 40 is equipped with adjustable swirl vanes 200 and/or with other devices such as adjustable flat vanes 210 upstream of the partition walls 60,70, a fuel enrichment bypass 190 and fuel flow redistributors 240. The swirl vanes 200 and the flat vanes 210 can be fixed. Higher fuel concentrations in the first concentric flow 130 of the fuel enhance ignition process; therefore in order to increase fuel concentration in the first concentric flow 130 of the fuel, the duct 40 is equipped with the fuel enrichment bypass 190. The bypass 190 transports a part of the fuel from the second parallel flow 90 of the fuel and from the third parallel flow 100 of the fuel in the duct 40 to the first concentric conduit 110 to form the first concentric flow 130. The amount of the fuel transported via bypass 190 is controlled by the swirl vanes 200 and/or flat vanes 210. The stage by stage ignition is improved and controlled in rear sections of the first 130, second 140 and third 150 concentric flow of fuel by keeping the pre ignition source 220 in operation. If the pre ignition source 220 goes out of operation, the ignition of the fuel 35 moves from the rear sections of the first 130, second 140 and third 150 concentric flow of fuel to outside, into the combustion area 20. During the boiler 25 start-up, after reaching approximately 30% of the total boiler capacity the pre ignition source 220 can be switched off. Therefore, the duct 40 serves as fuel ignition nozzle and as fuel injection nozzle when the pre ignition source 220 is switched off. Furthermore, use of the swirl vanes 200, the flat vanes 210, the fuel flow redistributors 240, the fuel enrichment bypass 190, duct temperature detectors 255, primary air velocity and temperature monitoring system 250 allow influencing the ignition process by controlling the velocity of the pulverized fuel/air mixture, stoichiometry of the mixture, and temperature in the duct 40. After the ignited fuel leaves duct outlet 55 and enters into the combustion area 20 a combustion flame is formed and stabilized with help of secondary air 260 provided by a fuel burner 230 which is a jet burner 231 or a round burner 232. After the ignitor 220 is switched off the combustion flame can stand alone.

As illustrated in FIG. 1B, a cross-sectional view of the duct 40 is shown along the line along A-A. In FIG. 1C, a cross-sectional view of the duct 40 is shown along the line along B-B and in FIG. 1D, a cross-sectional view of the duct 40 is shown along the line along C-C.

Figure 2A:
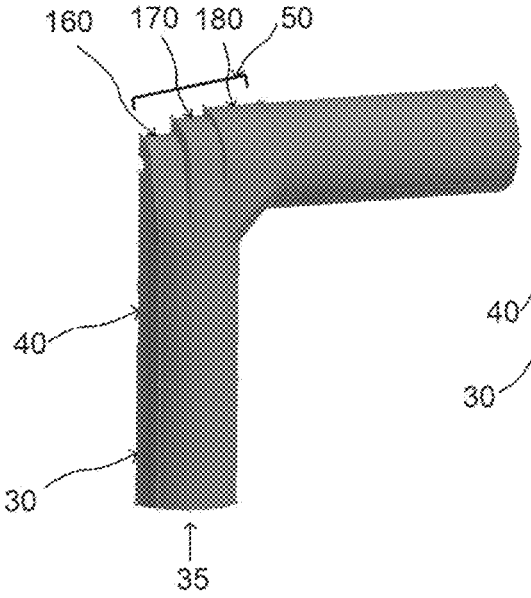
FIG. 2A is an isometric view of a duct in accordance with an exemplary embodiment of the present disclosure.
Figure 2B:
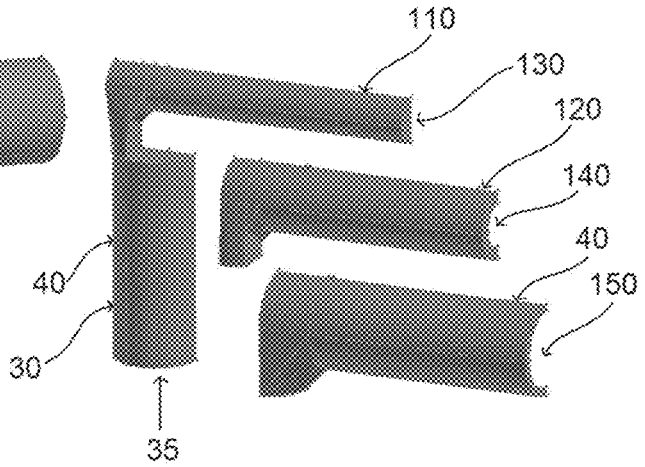
FIG. 2B is an enlarged view of the of the FIG. 2A depicting parallel and concentric flows in the duct in accordance with an exemplary embodiment of the present disclosure.

Referring now to FIG. 2A and FIG. 2B, an isometric view of the duct 40 is shown where the bend 50 includes a first portion 160 which is connected to the first partition plate 60. The first partition plate 60 is connected with the first concentric conduit 110 to transition the first parallel flow 80 of the fuel into the first concentric flow 130 of fuel. A second portion 170 is attached to the first portion 160 and in turn connected to the second partition plate 70 with the second concentric conduit 120 to transition the second parallel flow 90 into the second concentric flow 140 of fuel. The second concentric conduit 120 surrounds the first concentric conduit 110 in such a way that the first concentric flow 130 of fuel is surrounded by the second concentric flow 140 of fuel and remain separated as both the flow 130,140 flow in their respective conduits 110,120. A third portion 180 is attached to the second portion 170 and in turn transition the third parallel flow 100 of the fuel into the third concentric flow 150 of the fuel through the duct 40. The duct 40 surround the second concentric conduit 120 in such a way that the second concentric flow 140 of fuel is surrounded by the third concentric flow 150 of fuel and remain separated as both the flow 140,150 flow in their respective conduits 120,40. The first portion 160, second portion 170 and the third portion 180 are attached and configured to form a stepping configuration. The ignition of the fuel occurs in rear sections of first 130, second 140 and third 150 concentric flow of fuel downstream of the bend 50.

Figures 3A, 3B, 3C:
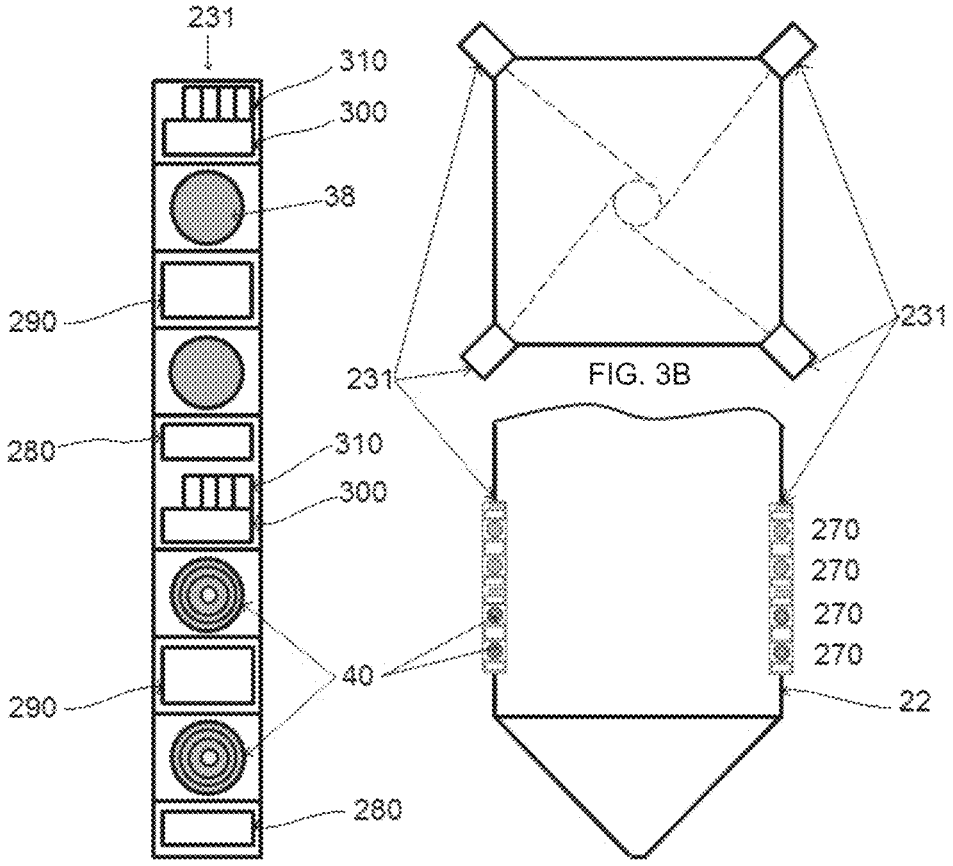
FIG. 3A illustrates an arrangement of jet burners in which a duct is integrated in accordance with various exemplary embodiments of the present disclosure.
FIG. 3B illustrates a top view of a tangential fired combustion system with the jet burners having integrated ducts.
FIG. 3C illustrates a side view of a combustion chamber of a boiler with the jet burner layers having integrated ducts.

In reference to FIG. 3A, an arrangement of the jet burners 231 includes the ducts 40 in the few jet burners 231 along with conventional nozzles 38 in other jet burners placed on a combustion chamber 22 of a tangentially fired combustion system. There is a combination of lower air supply 280 and intermediate air supply 290 adjusted around the jet burner 231 having the duct 40. Furthermore, jet burner 231 having the duct 40 is placed between the intermediate air supply 290 and upper air supply 300 with offset air supply 310. In FIG. 3B the jet burners 231 having integrated ducts 40 have been placed in a tangential fired position. Furthermore, FIG. 3C illustrates a side view of the combustion chamber 22 of the boiler with the jet burner layers 270 having integrated ducts 40. In order to start-up the tangentially fired boiler without using any secondary fuel, for example, oil or gas, a minimum four conventional nozzles 38 is replaced with duct 40 making the one burner layer 270 thereby, the firing capacity of the ducts 40 is equal to or greater than 30% of boiler firing capacity. In case this condition is not be fulfilled with the one burner layer 270, than two or more burner layers 270 have to be equipped with ducts 40.

Figure 4A:
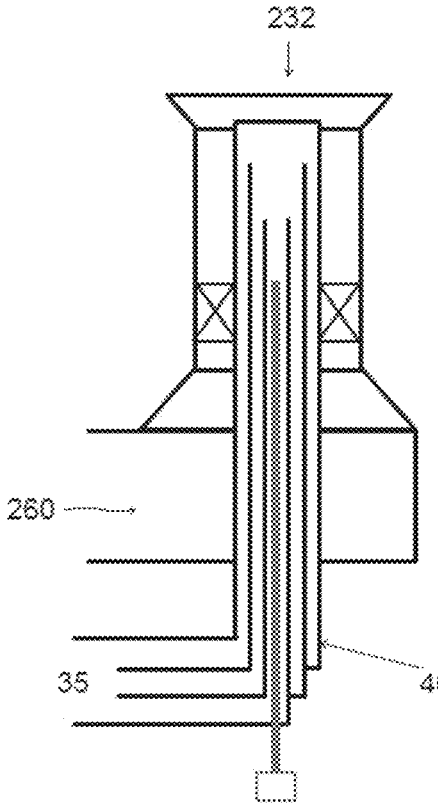
FIG. 4A schematically shows a round burner in which duct is integrated in accordance with an exemplary embodiment of the present disclosure.
Figure 4B:
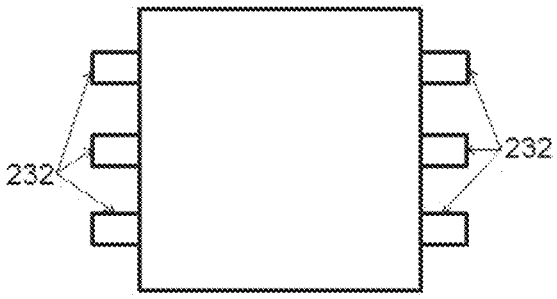
FIG. 4B shows a top view of a wall fired combustion system of a boiler with the round burners having integrated ducts.
Figure 4C:
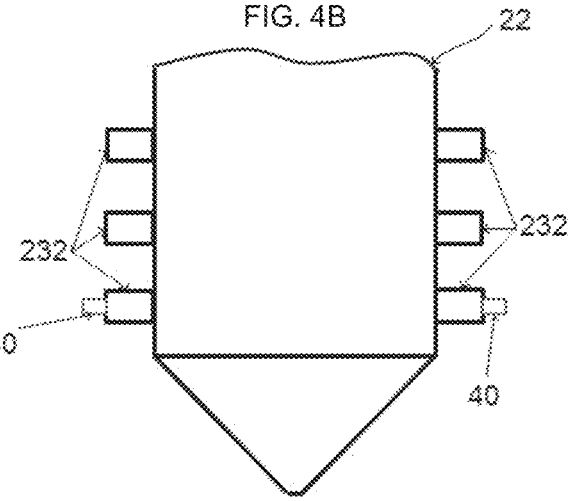
FIG. 4C shows a side view of a wall fired combustion chamber equipped with the round burners with integrated ducts.

In FIG. 4A, an arrangement of the round burner 232 includes the ducts 40 in the few round burners 232 along with normal nozzles in other round burners placed on a combustion chamber 22 of a wall fired combustion system. In FIG. 4B the round burners 232 having integrated ducts 40 have been placed in a wall fired position. In FIG. 4C side views of the combustion chamber 22 of the boiler with the round burner 232 having integrated ducts 40.

In order to start-up the wall fired boiler without using any secondary fuel, for example, oil or gas, several round burners 232 are equipped with ducts 40. The conventional nozzle 38 within the round burners 232 are replaced with ducts 40, as shown in FIG. 4C, thereby, the firing capacity of the round burners 232 equipped with ducts 40 is equal to or greater than 30% of boiler firing capacity.

The system 10 is shown and described as having concentric conduits 110, 120 and the duct 40 also acting as concentric conduit. However, the present disclosure is not limited in this regard. For example, the disclosed system 10 may have a duct 40 with multiple numbers on concentric conduits depending upon the fuel amount and size of the system 10. Similarly the shape and configuration of the one or more concentric conduit may vary.

A method for providing combustion in the boiler 25 having a combustion area 20 is provided. During the operation of the system 10, the fuel 35 in the form of dust of pulverized coal along with primary air is conveyed through the fuel pipe 30, through the duct 40, and into the combustion area 20 of the boiler 25. A part of the fuel 35 in the form of the first parallel flow 80 flowing between the outer perimeter 45 and the first partition plate 60 is in transition into the first concentric flow 130 of the fuel while passing through the bend 50. The first partition plate 60 is connected to the first concentric conduit 110 through the first portion 160 in such a way that the first parallel flow 80 after transition into the first concentric flow 130 flowing through the first concentric conduit 110 without mixing with the other concentric flows. Similarly another part of the fuel 35 in the form of the second parallel flow 90 flowing between the first partition plate 60 and the second partition plate 70 is in transition into the second concentric flow 140 of the fuel while passing through the bend 50. The second partition plate 70 is connected to the second concentric conduit 120 through the second portion 170 in such a way that the second parallel flow 90 after transition into the second concentric flow 140 flowing through the second concentric conduit 120 without mixing with the other concentric flows. Remaining part of the fuel 35 in the form of the third parallel flow 100 flowing between the second partition plate 70 and the outer perimeter 45 is in transition into the third concentric flow 150 of the fuel while passing through the bend 50. The duct 40 is transformed due to the third portion 180 in such a way that the third parallel flow 100 after transition into the third concentric flow 150 flowing through the duct 40 without mixing with the other concentric flows. The bend is including the first portion 160, second portion 170 and the third portion 180 and all the portions 160, 170 and 180 are attaching to each other in such a way to form a stepping configuration. The duct 40 is surrounding the second concentric conduit 120, which is further surrounding the first concentric conduit 110. Further increasing the fuel 35 concentration in the first concentric flow 130 of the fuel occurs through the fuel enrichment bypass 190 by equipping the duct 40. The bypass 190 allows transporting a part of the fuel from the second parallel flow 90 of the fuel and from the third parallel flow 100 of the fuel in the duct 40 to the first concentric conduit 110 forming the first concentric flow 130. The amount of the fuel transported via bypass 190 is controlled by the swirl vanes 200 and/or flat vanes 210. The stage by stage ignition is improved and controlled in rear sections of the first 130, second 140 and third 150 concentric flow of fuel by keeping the pre ignition source 220 in operation.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above examples teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the scope of the claims of the present disclosure.

What is claimed is:

1. A system for providing combustion in a boiler having a combustion area comprising:

a fuel pipe operable to deliver fuel;

a duct with an outer perimeter having a bend, the duct being in fluid communication with the fuel pipe and the combustion area of the boiler;

wherein the duct comprises:

a first planar partition plate disposed within and spanning the duct to form a first parallel flow of the fuel between the outer perimeter and the first partition plate, upstream of the bend;

a first concentric conduit, positioned in the duct downstream of the bend, to deliver a first concentric flow of the fuel for combustion, the bend having a first portion configured to connect the first partition plate with the first concentric conduit wherein the bend is between the first partition plate and the first concentric conduit and is configured to transition the first parallel flow of the fuel into the first concentric flow of the fuel;

a second planar partition plate, disposed within and spanning the duct, to form a second parallel flow of the fuel between the first partition plate and the second partition plate upstream of the bend; and a second concentric conduit, positioned in the duct downstream of the bend, to deliver a second concentric flow of the fuel for combustion, the bend having a second portion configured to connect the second partition plate with the second concentric conduit, wherein the bend is between the second partition plate and the second concentric conduit and is configured to transition the second parallel flow of the fuel into the second concentric flow of the fuel.

2. The system according to claim 1, wherein the second partition plate forms a third parallel flow of the fuel between the outer perimeter and the second partition plate, upstream of the bend, the duct is positioned downstream of the bend to deliver a third concentric flow of the fuel for combustion, and the bend is configured in the duct to transition the third parallel flow of the fuel into the third concentric flow of the fuel.

3. The system according to claim 2, wherein the bend comprises:

a third portion attached to the second portion and configured to transition the third parallel flow of the fuel into the third concentric flow of the fuel through the duct, wherein the second concentric conduit surrounds the first concentric conduit;

wherein the duct surrounds the second concentric conduit, and wherein the first portion, the second portion, and the third portion are configured to form a stepping configuration.

4. The system according to claim 3, further comprising a bypass is provided in the duct upstream of the bend to transport a part of the second parallel flow of the fuel and a part of the third parallel flow of the fuel in the duct to the first concentric conduit through the first portion of the bend.

5. The system according to claim 4, wherein at least one swirl vane and at least one flat vanes is provided upstream of the partition plates to control the amount of the fuel transported through the bypass and/or first, second, and third parallel flow.

6. The system according to claim 1, wherein a pre ignition source is positioned in the duct in the first concentric flow of fuel downstream of the bend.

7. The system according to claim 1, wherein, the duct is an ignition-injection nozzle.

8. The system according to claim 7, wherein ignition of the fuel occurs in rear sections of first, second, and third concentric flow of fuel downstream of the bend.

9. A system for providing combustion in a boiler having a combustion area comprising:

a fuel burner, wherein the fuel burner is fitted with the ignition-injection nozzle as claimed in claim 7.

10. A method for providing combustion in a boiler having a combustion area comprising:

providing a fuel pipe operable to deliver fuel;

providing a duct with an outer perimeter having a bend, wherein the duct is in fluid communication with the fuel pipe and the combustion area of the boiler;

disposing a first planar partition plate within and spanning the duct to enable forming a first parallel flow of the fuel between the outer perimeter and the first partition plate, upstream of the bend;

positioning a first concentric conduit in the duct downstream of the bend, the bend having a first portion configured to connect the first partition plate with the first concentric conduit;

configuring the bend between the first partition plate and the first concentric conduit to enable transition of the first parallel flow of the fuel into the first concentric flow of the fuel;

disposing a second planar partition plate within and spanning the duct to enable forming a second parallel flow of the fuel between the first partition plate and the second partition plate upstream of the bend;

positioning a second concentric conduit in the duct downstream of the bend, the bend having a second portion configured to connect the second partition plate with the second concentric conduit, the second concentric conduit operable to enable delivery of a second concentric flow of the fuel for combustion; and configuring the bend between the second partition plate and the second concentric conduit to enable transition of the second parallel flow of the fuel into the second concentric flow of the fuel.

11. The method according to claim 10, further comprising:

forming a third parallel flow of the fuel between the outer perimeter and the second partition plate, upstream of the bend;

positioning the duct downstream of the bend to enable delivery of a third concentric flow of the fuel for combustion; and configuring the bend in the duct to enable transition of the third parallel flow of the fuel into the third concentric flow of the fuel.

12. The method according to claim 11, wherein configuring the bend further comprises:

attaching a third portion to the second portion to enable transition the third parallel flow of the fuel into the third concentric flow of the fuel through the duct, wherein the second concentric conduit surrounds the first concentric conduit;

wherein the duct surrounds the second concentric conduit, and wherein the first portion, the second portion, and the third portion are configured to form a stepping configuration.

13. The method according to claim 11, further comprising:

providing a bypass in the duct upstream of the bend to transport a part of the second parallel flow of the fuel and a part of the third parallel flow of the fuel in the duct to the first concentric conduit through first portion of the bend.

14. The method according to claim 10, further comprising:

providing at least one swirl vane and at least one flat vanes upstream of the partition plates to control amount of the fuel transported through the bypass.

15. The method according to claim 10, further comprising:

positioning a pre ignition source in the duct in the first concentric flow of fuel downstream of the bend.

16. The method according to claim 10, wherein the duct is an ignition-injection nozzle.

17. The method according to claim 11, further comprising:

igniting the fuel in rear sections of the first, the second, and the third concentric flow of fuel downstream of the bend.

18. The method according to claim 16, further comprising:

using the ignition-injection nozzle for combustion in a fuel burner of the boiler.

* * * * *